US009323193B2

(12) United States Patent
Takahashi et al.

(10) Patent No.: US 9,323,193 B2
(45) Date of Patent: Apr. 26, 2016

(54) FIXING DEVICE AND IMAGE FORMING APPARATUS

(71) Applicant: KYOCERA Document Solutions Inc., Osaka (JP)

(72) Inventors: Hironori Takahashi, Osaka (JP); Motoki Moriguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/677,208

(22) Filed: Apr. 2, 2015

(65) Prior Publication Data

US 2015/0293482 A1 Oct. 15, 2015

(30) Foreign Application Priority Data

Apr. 15, 2014 (JP) ..... 2014-083313

(51) Int. Cl.
*G03G 15/20* (2006.01)

(52) U.S. Cl.
CPC ..... *G03G 15/2053* (2013.01); *G03G 15/2064* (2013.01); *G03G 15/2089* (2013.01); *G03G 2215/2016* (2013.01); *G03G 2215/2032* (2013.01)

(58) Field of Classification Search
CPC ..... G03G 15/20
USPC ..... 399/329
See application file for complete search history.

(56) References Cited

U.S. PATENT DOCUMENTS

2013/0266355 A1* 10/2013 Yoshiura et al. ..... 399/329

FOREIGN PATENT DOCUMENTS

JP 2012-128075 A 7/2012

* cited by examiner

*Primary Examiner* — Clayton E Laballe
*Assistant Examiner* — Kevin Butler
(74) *Attorney, Agent, or Firm* — Studebaker & Brackett PC

(57) ABSTRACT

A fixing device includes a fixing belt, a pressuring member, a pressing member, a heat source and a heat transmitting member. The fixing belt is arranged rotatably. The pressuring member is arranged rotatably to come into pressure contact with the fixing belt so as to form a fixing nip. The pressing member presses the fixing belt to a side of the pressuring member. The heat source is arranged at the inside in a radial direction of the fixing belt to radiate a radiant heat. The heat transmitting member comes into contact with an inner circumference face of the fixing belt to absorb the radiant heat radiated from the heat source. A part of the heat transmitting member is sandwiched between the fixing belt and the pressing member.

9 Claims, 5 Drawing Sheets

FIXING DEVICE AND IMAGE FORMING APPARATUS

INCORPORATION BY REFERENCE

This application is based on and claims the benefit of priority from Japanese Patent application No. 2014-083313 filed on Apr. 15, 2014, the entire contents of which are incorporated herein by reference.

BACKGROUND

The present disclosure relates to a fixing device fixing a toner image onto a sheet and an image forming apparatus including the fixing device.

Conventionally, an electrographic image forming apparatus, such as a copying machine or a printer, includes a fixing device fixing a toner image onto a sheet (a recording medium).

For example, there is the fixing device including a fixing belt, a pressuring member coming into pressure contact with the fixing belt to form a fixing nip, a pressing member pressing the fixing belt to a side of the pressuring member and a heat source radiating a radiant heat.

In the fixing device with such a configuration, when the fixing belt is directly heated by the heat source, there are problems that excessive temperature rise of the fixing belt is caused and a property (a heat resisting property) of a lubricant applied between the fixing belt and the pressing member is deteriorated. Further, there are problems that the fixing belt is deformed by the excessive temperature rise of the fixing belt, and then, contact between a contact type temperature detecting part (a thermistor) and the fixing belt is lost to lose general control and a distance between a non-contact type excessive temperature rise preventing device (a thermostat) and the fixing belt is varied.

Thereupon, in the fixing device with the above-mentioned configuration, a heat transmitting member coming into contact with an inner circumference face of the fixing belt is heated by the heat source and the fixing belt is heated by heat transmitted from the heat transmitting member.

However, in the fixing device with the above-mentioned configuration, the heat transmitting member may not come into contact with the fixing belt at a corresponding area to the fixing nip. In such a case, the heat cannot be transmitted from the heat transmitting member to the fixing belt at the corresponding area to the fixing nip and it is feared that it becomes difficult to surely fix the toner image onto the sheet. Moreover, a warm-up time (a time required for heating the fixing nip to temperature allowing the toner image to be fixed onto the sheet) is lengthened and it is feared that energy saving performance is deteriorated.

SUMMARY

In accordance with an embodiment of the present disclosure, a fixing device includes a fixing belt, a pressuring member, a pressing member, a heat source and a heat transmitting member. The fixing belt is arranged rotatably. The pressuring member is arranged rotatably to come into pressure contact with the fixing belt so as to form a fixing nip. The pressing member presses the fixing belt to a side of the pressuring member. The heat source is arranged at the inside in a radial direction of the fixing belt to radiate a radiant heat. The heat transmitting member comes into contact with an inner circumference face of the fixing belt to absorb the radiant heat radiated from the heat source. A part of the heat transmitting member is sandwiched between the fixing belt and the pressing member.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
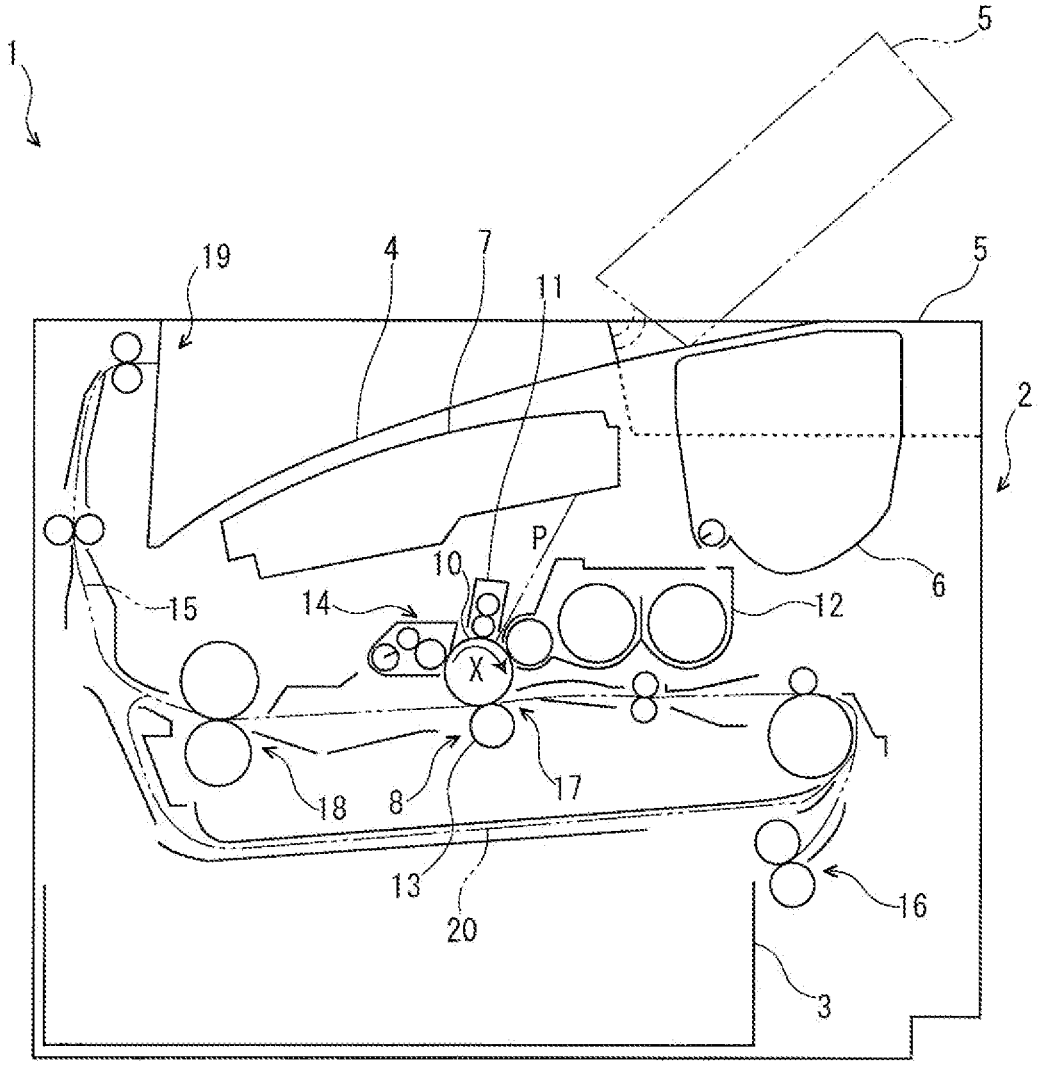
FIG. 1 is a schematic diagram schematically showing a printer according to an embodiment of the present disclosure.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, an ejected sheet tray 4 is formed. To the top face of the printer main body 2, an upper cover 5 is openably/closably attached at a lateral side of the ejected sheet tray 4 and, below the upper cover 5, a toner container 6 is installed.

In an upper part of the printer main body 2, an exposure device 7 composed of a laser scanning unit (LSU) is located below the ejected sheet tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end in the conveying path 15, a sheet feeding part 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data is carried out to the photosensitive drum 10 by a laser light (refer to a two-dot chain line P in FIG. 1) from the exposure device 7, thereby forming an electrostatic latent image on the surface of the photosensitive drum 10. Subsequently, the development device 12 develops the electrostatic latent image to a toner image by a toner (a developer).

On the other hand, a sheet picked up from the sheet feeding cartridge 3 by the sheet feeding part 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a downstream side in the conveying path 15 to be inserted to the fixing device 18, and then, the toner image is fixed onto the sheet in the fixing device 18. The sheet with the fixed toner image is ejected from the sheet ejecting part 19 to the ejected sheet tray 4. The toner remained on the photosensitive drum 10 is collected by the cleaning device 14.

Next, with reference to FIGS. 2-5, the fixing device 18 will be described. Hereinafter, it will be described so that the front side of the fixing device 18 is positioned at the near side on FIG. 2, for convenience of explanation. An arrow Y in FIG. 2 indicates a conveying direction of the sheet (left and right directions in the embodiment). An arrow Fr in each figure indicates the front side of the fixing device 18.

Figure 2:
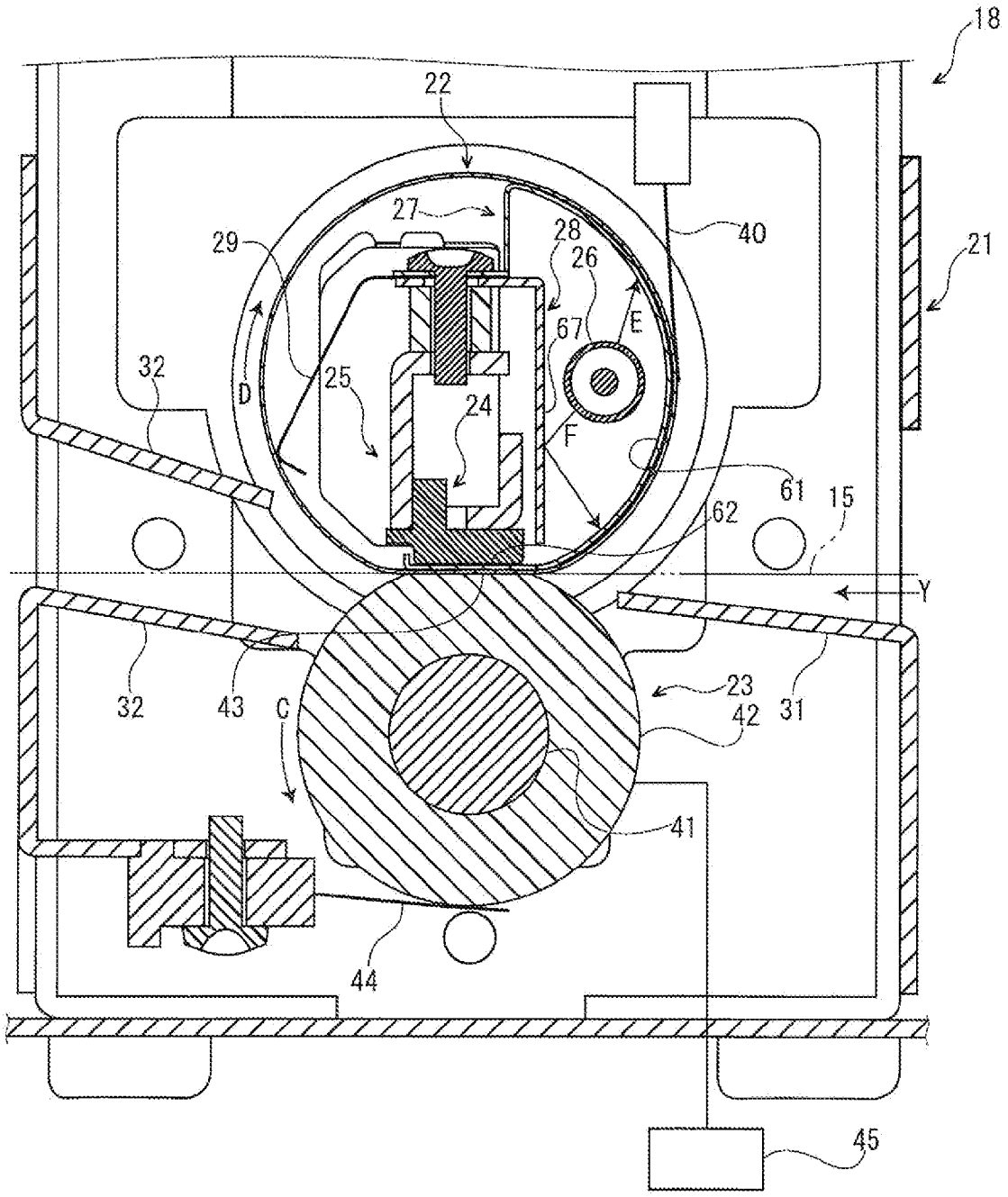
FIG. 2 is a sectional view showing a fixing device according to the embodiment of the present disclosure.

As shown in FIG. 2, the fixing device 18 mainly includes a box-like formed fixing frame 21, a fixing belt 22, a pressuring roller 23 (a pressuring member), a pressing member 24, a supporting member 25, a heater 26 (a heat source), a heat transmitting member 27, a reflecting member 28 and plate springs 29 (biasing members). The fixing belt 22 is installed in an upper part of the fixing frame 21. The pressuring roller 23 is installed in a lower part of the fixing frame 21. The pressing member 24 is arranged at the inside in a radial direction of the fixing belt 22. The supporting member 25 is arranged at the inside in the radial direction of the fixing belt 22 and at an upper side of the pressing member 24. The heater 26 is arranged at the inside in the radial direction of the fixing belt 22 and at a right upper side of the supporting member 25. The heat transmitting member 27 is arranged at the inside in the radial direction of the fixing belt 22 and at both upper and lower sides and a right side of the heater 26. The reflecting member 28 is arranged at the inside in the radial direction of the fixing belt 22 and at a left side of the heater 26. Each plate spring 29 is arranged at the inside in the radial direction of the fixing belt 22 and at a left side of the supporting member 25.

In a right side part of the fixing frame 21, an approach guide 31 is formed below the conveying path 15 for the sheet. In a left side part of the fixing frame 21, ejection guides 32 are formed both above and below the conveying path 15 for the sheet.

Figure 3:
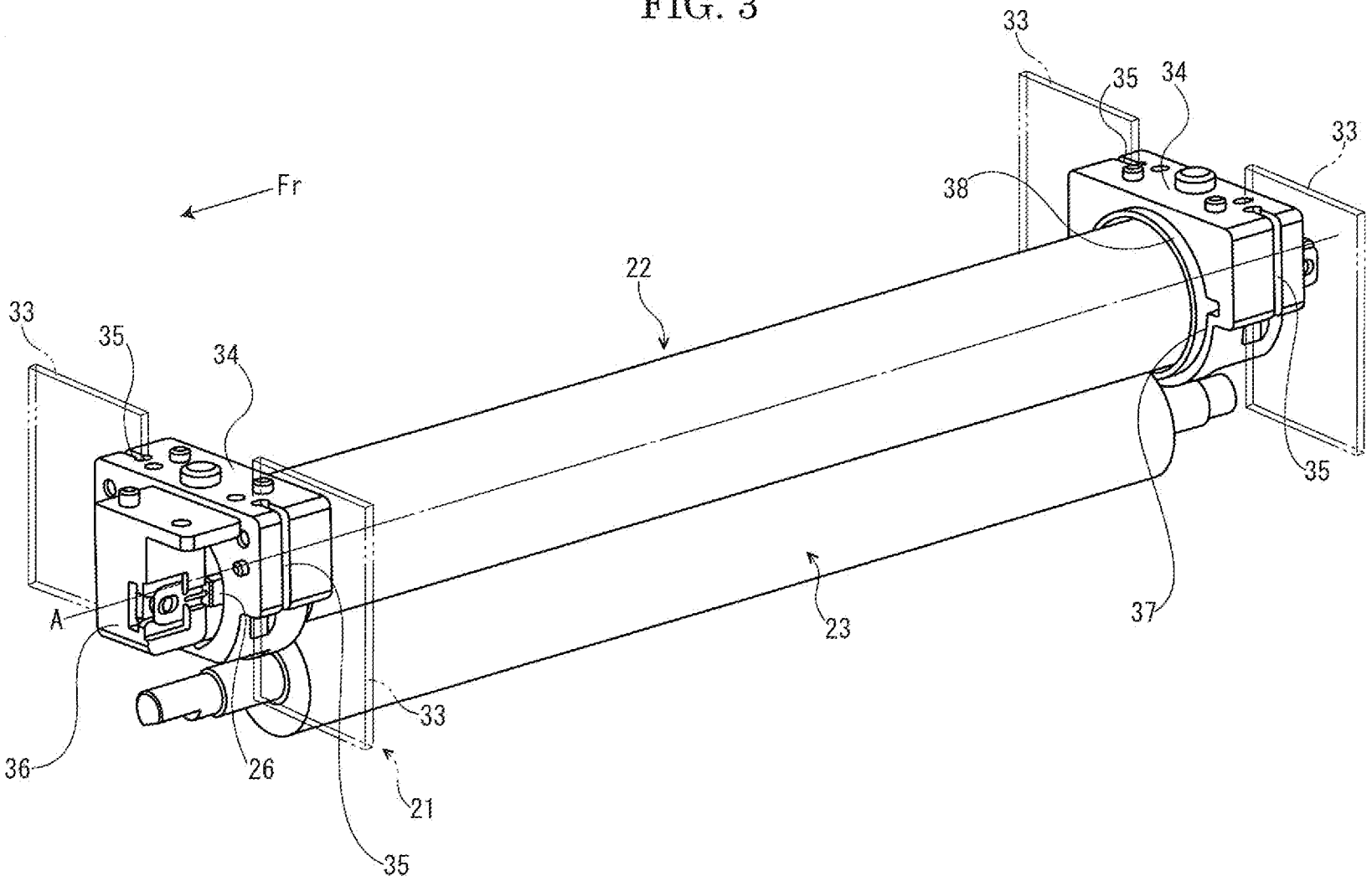
FIG. 3 is a perspective view showing a fixing belt and its periphery in the fixing device according to the embodiment of the present disclosure.
Figure 4:
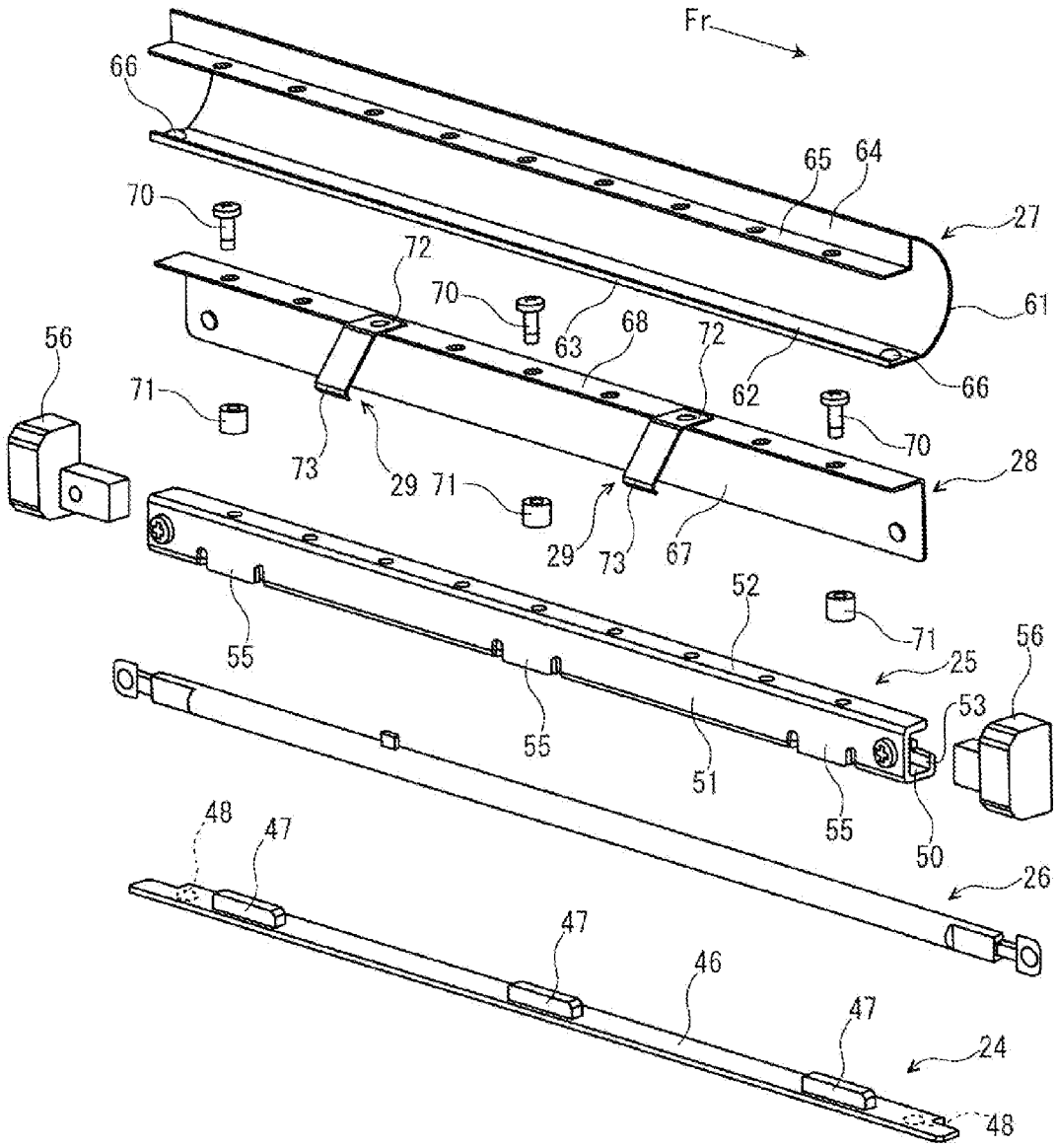
FIG. 4 is a perspective exploded view showing members arranged at the inside in a radial direction of the fixing belt in the fixing device according to the embodiment of the present disclosure.
Figure 5:
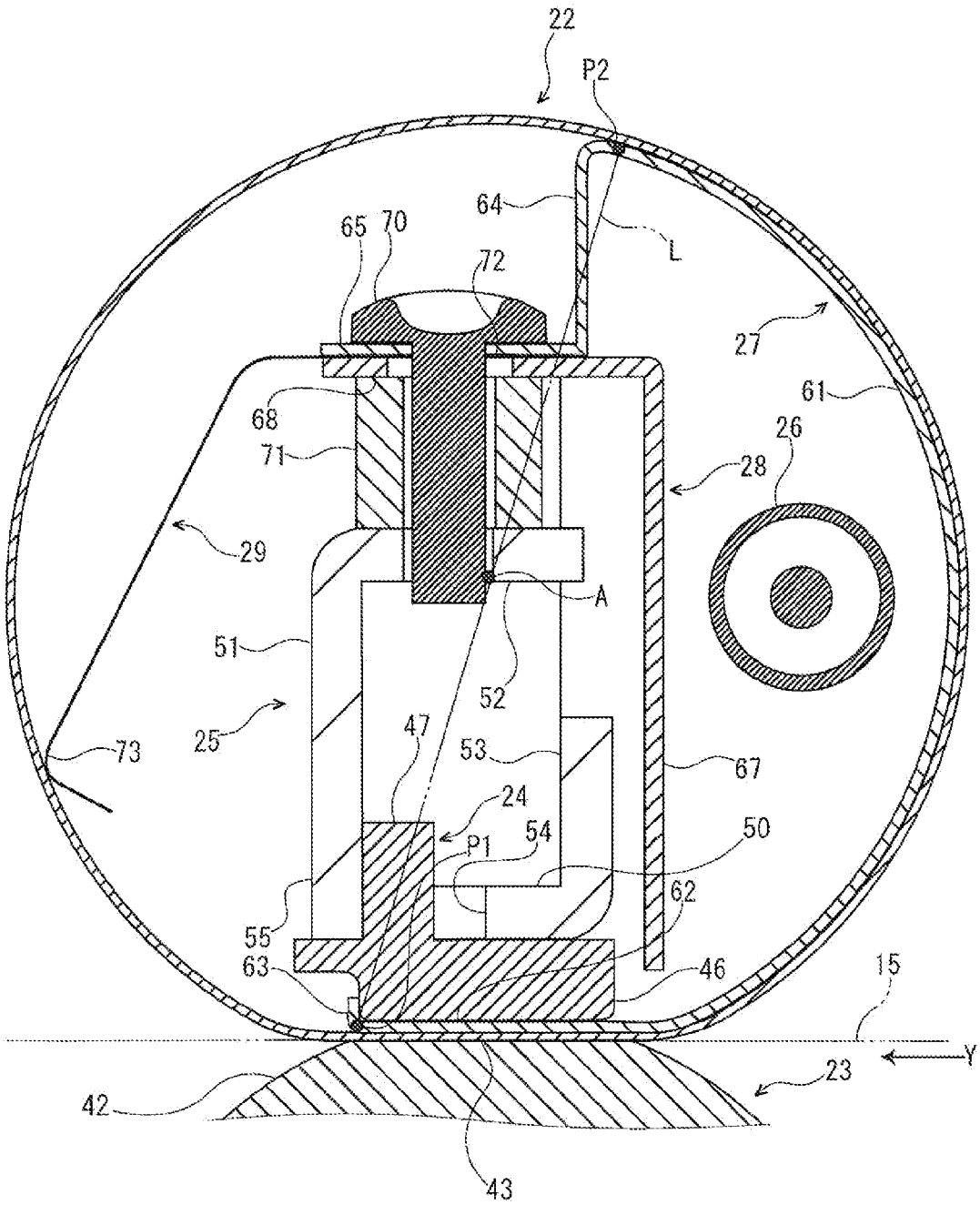
FIG. 5 is a sectional view showing the fixing belt and its periphery in the fixing device according to the embodiment of the present disclosure.

As shown in FIG. 3, in both front and rear end parts of the fixing frame 21, pairs of guide walls 33 facing to each other at a predetermined interval are arranged. Between the respective pairs of guide walls 33, housings 34 are arranged. In both left and right parts of the respective housings 34, guide grooves 35 are formed along upward and downward directions. The guide grooves 35 are engaged with inner edge parts of the pairs of guide walls 33.

To faces at the outside in forward and backward directions of the housings 34, heater attachment pieces 36 are fixedly attached. In faces at the inside in the forward and backward directions of the housings 34, installation recessed parts 37 are formed. Into the installation recessed parts 37, bearings (pulleys) 38 are installed in rotatable states. The bearings 38 are respectively attached to both front and rear end parts of the fixing belt 22. Thereby, the fixing belt 22 is rotatably supported by the housings 34 via the bearings 38 so that the fixing belt 22 can rotate around a rotation axis A extending in the forward and backward directions. That is, in the embodiment, the forward and backward directions equal to a rotation axis direction of the fixing belt 22.

The fixing belt 22 (refer to FIG. 2 and other figures) is formed in a cylindrical shape elongated in the forward and backward directions. The fixing belt 22 has flexibility and is formed in an endless shape in a circumferential direction. The fixing belt 22 is composed of, for example, a base material layer, and a release layer covering the base material layer. The base material layer of the fixing belt 22 is made of resin, such as polyimide (PI). The base material layer of the fixing belt 22 has, for example, an internal diameter of ϕ30 mm and a thickness of 90 μm. The release layer of the fixing belt 22 is made of, for example, perfluoro alkoxy alkane (PFA) tube and has a heat resisting property and toner releasability. The release layer of the fixing belt 22 has, for example, a thickness of 30 μm. Each figure shows the respective layers (the base material layer and the release layer) of the fixing belt 22 without distinguishing. A right side part of an outer circumference face of the fixing belt 22 comes into contact with a first thermistor 40 detecting temperature of the fixing belt 22.

The pressuring roller 23 (refer to FIG. 2 and other figures) is formed in a columnar shape elongated in the forward and backward directions. The pressuring roller 23 is composed of, for example, a columnar core material 41, an elastic layer 42 provided around the core material 41 and a release layer (not shown) covering the elastic layer 42. The core material 41 of the pressuring roller 23 is made of, e.g. metal, such as aluminum. The core material 41 of the pressuring roller 23 has, for example, an external diameter of ϕ26 mm. The elastic layer of the pressuring roller 23 has a heat insulation property and is made of, for example, silicone rubber. The elastic layer 42 of the pressuring roller 23 has, for example, a thickness of 3 mm. The release layer (not shown) of the pressuring roller 23 is made of, for example, PFA tube. The release layer of the pressuring roller 23 has, for example, a thickness of 30 μm.

The pressuring roller 23 is arranged at a lower side (the outside) of the fixing belt 22 in parallel to the fixing belt 22. The pressuring roller 23 is pressured to an upper side (a side of the fixing belt 22) at a predetermined load (e.g. 300N) by a pressuring mechanism (not shown) using a spring and others to come into pressure contact with the fixing belt 22. Thereby, between the fixing belt 22 and the pressuring roller 23, a fixing nip 43 is formed. The pressuring roller 23 is rotatably supported by a bearing member (not shown). A lower end part of an outer circumference face of the pressuring roller 23 comes into contact with a second thermistor 44 detecting temperature of the pressuring roller 23. The pressuring roller 23 is connected to a drive source 45 composed of a motor and others via a drive gear (not shown).

The pressing member 24 (refer to FIGS. 4 and 5 and other figures) is formed in an elongated shape in the forward and backward directions. The pressing member 24 is made of, for example, heat resistant resin, such as liquid crystal polymer (LCP).

The pressing member 24 includes a planer main body part 46 and a plurality of protruding parts 47 (in the embodiment, three protruding parts 47) provided in an upper face (a face at a side separated from the fixing nip 43) of the main body part 46 at intervals in the forward and backward directions. In both front and rear end parts of a lower face of the main body part 46, engaged gaps 48 are formed. The lower face of the main body part 46 presses the fixing belt 22 to a lower side (a side of the pressure roller 23).

The supporting member 25 (refer to FIGS. 4 and 5 and other figures) is formed in an elongated shape in the forward and backward directions. The supporting member 25 is formed, for example, by bending one plate metal made of metal, such as steel special use stainless (SUS).

The supporting member 25 has a bottom plate 50, a first lateral plate 51 bent from a left end part of the bottom plate 50 to an upper side, a top plate 52 bent from an upper end part of the first lateral plate 51 to a right side and a second lateral plate 53 bent from a right end part of the bottom plate 50 to the upper side.

A lower face of the bottom plate 50 of the supporting member 25 comes into contact with the upper face of the main body part 46 of the pressing member 24. Thereby, the pressing member 24 is supported by the supporting member 25 so that a warp in the forward and backward directions of the pressing member 24 is restricted. In a left side part of the bottom plate 50 of the supporting member 25, a plurality of insertion holes (in the embodiment, three insertion holes 54) are formed at intervals in the forward and backward directions. Into each insertion hole 54, each protruding part 47 of the pressing member 24 is inserted. In a lower end part of the first lateral plate 51 of the supporting member 25, a plurality of restriction pieces 55 (in the embodiment, three restriction pieces 55) are formed at respective left sides (at a downstream side in a sheet conveying direction) of the insertion holes 54 at intervals in the forward and backward directions. Each restriction piece 55 is arranged at a left side (at the downstream side in the sheet conveying direction) of each protruding part 47 of the pressing member 24 to come into contact with each protruding part 47 of the pressing member 24.

To both front and rear end parts of the supporting member 25, holding members 56 are respectively attached. Respective inside parts in the forward and backwards directions of the holding members 56 are inserted into both the front and rear end parts of the supporting member 25. Each holding member 56 is supported by each housing 34 (refer to FIG. 3 and other figures).

The heater 26 (refer to FIGS. 4 and 5 and other figures) is composed of, for example, a halogen heater. The heater 26 is surrounded by the heat transmitting member 27 and the reflecting member 28. The heater 26 is configured so as to generate heat by supplying current and to radiate a radiant heat (a radiant light). Both front and rear end parts of the heater 26 are attached to the heater attachment pieces 36 (refer to FIG. 3 and other figures).

The heat transmitting member 27 (refer to FIGS. 4 and 5 and other figures) is formed in an elongated shape in the forward and backward directions. The heat transmitting member 27 is formed, for example, by bending and curving one plate metal made of metal with high thermal conductivity, such as aluminum or SUS. The heat transmitting member 27 has, for example, a thickness of 0.5 mm.

The heat transmitting member 27 has a first heat transmitting part 61, a second heat transmitting part 62, a guide part 63, a first bent part 64 and a second bent part 65. The second heat transmitting part 62 is extended from a lower end part (an end part at a side of the fixing nip 43) of the first heat transmitting part 61 to the left side (to the downstream side in the sheet conveying direction). The guide part 63 is bent from a left end part (an end part at the downstream side in the sheet conveying direction) of the second heat transmitting part 62 to an upper side (to the side separated from the fixing nip 43). The first bent part 64 is bent from an upper end part (an end part at the side separated from the fixing nip 43) of the first heat transmitting part 61 to a lower side (to the side of the fixing nip 43). The second bent part 65 is bent from a lower end part (an end part at the side of the fixing nip 43) of the first bent part 64 to the left side (to the downstream side in the sheet conveying direction).

Onto an inner face of the heat transmitting member 27, a photothermal conversion paint (e.g. heat resistant paint No. 8000 made by Okitsumo Inc.) is applied at parts (e.g. the first heat transmitting part 61 and the first bent part 64) radiated by the radiant heat from the heater 26. Onto an outer face of the heat transmitting member 27, nickel plating or fluorine coating is applied at parts (e.g. the first heat transmitting part 61 and the second heat transmitting part 62) coming into contact with the inner circumference face of the fixing belt 22.

The first heat transmitting part 61 of the heat transmitting member 27 is curved to a right side (to an upstream side in the sheet conveying direction) in an arc-like shape to cover both the upper and lower sides and the right side of the heater 26. The first heat transmitting part 61 comes into contact with a right side part (a part at the upstream side in the sheet conveying direction) of the inner circumference face of the fixing belt 22.

The second heat transmitting part 62 of the heat transmitting member 27 is extended along the left and right directions (the sheet conveying direction). The second heat transmitting part 62 comes into contact with a lower side part (a part at the side of the fixing nip 43) of the inner circumference face of the fixing belt 22. The second heat transmitting part 62 is sandwiched between the lower side part of the fixing belt 22 and the main body part 46 of the pressing member 24. A length of a straight line L passing through the rotation axis A of the fixing belt 22 (a rotation center of the fixing belt 22) from a left end part P1 (a part at the downstream side in the sheet conveying direction) of the second heat transmitting part 62 to a point P2 on the first heat transmitting part 61 is longer than an internal diameter of the fixing belt 22 in a state that the heat transmitting member 27 does not come into contact with the inner circumference face of the fixing belt 22 (a state before the heat transmitting member 27 is attached). In upper faces of both front and rear end parts of the second heat transmitting part 62, engaging protrusions 66 are formed so as to engage with the respective engaged gaps 48 formed in the lower face of the main body part 46 of the pressing member 24.

The guide part 63 of the heat transmitting member 27 is arranged at a left side (at the downstream side in the sheet conveying direction) of the main body part 46 of the pressing member 24 to come into contact with the main body part 46 of the pressing member 24.

The reflecting member 28 (refer to FIGS. 4 and 5 and other figures) is formed in an elongated shape in the forward and backward directions. The reflecting member 28 is formed, for example, by bending one plate metal made of metal, such as aluminum with high brilliance. The reflecting member 28 has, for example, a thickness of 0.5 mm. The reflecting member 28 is arranged so as to cover a right side to an upper side of the supporting member 25.

The reflecting member 28 has a reflecting part 67 arranged along a vertical direction and a fixed part 68 bent from an upper end part (an end part at the side separated from the fixing nip 43) of the reflecting part 67 to the left side (to the downstream side in the sheet conveying direction).

A right side face (a face at a side of the heater 26) of the reflecting part 67 of the reflecting member 28 is a reflecting face (a mirror face) reflecting the radiant heat radiated from the heater 26 to direct reflected heat toward the first heat transmitting part 61 of the heat transmitting member 27. The reflecting part 67 is arranged so as to partition the heater 26 from the supporting member 25.

The fixed part 68 of the reflecting member 28 is fixedly attached to the top plate 52 of the supporting member 25 and the second bent part 65 of the heat transmitting member 27 by screws 70 (fastening members). Between the fixed part 68 and the top plate 52 of the supporting member 25, heat insulating spacers 71 fitted around respective outer circumferences of the screws 70 are interposed. Therefore, a lower face of the fixed part 68 does not come into contact with an upper face of the top plate 52 of the supporting member 25. An upper face of the fixed part 68 comes into contact with a lower face of the second bent part 65 of the heat transmitting member 27.

Each plate spring 29 is made of, for example, metal, such as SUS. Each plate spring 29 has, for example, a thickness of 0.2 mm. Proximal end parts 72 of the plate springs 29 are sandwiched between the second bent part 65 of the heat transmitting member 27 and the fixed part 68 of the reflecting member 28. Distal end parts 73 of the plate springs 29 come into contact with the left side part (a part at the downstream side in the sheet conveying direction) of the inner circumference face of the fixing belt 22 to bias the fixing belt 22 to the left side (to the downstream side in the sheet conveying direction). That is, the distal end part 73 of each plate spring 29 comes into contact with an opposite part to the right side part (a part coming into contact with the first heat transmitting part 61 of the heat transmitting member 27) of the inner circumference face of the fixing belt 22.

In the fixing device 18 configured as mentioned above, in order to fix the toner image onto the sheet, the drive source 45 works to rotate the pressuring roller 23 as indicated by an arrow C in FIG. 2. When the pressuring roller 23 is thus rotated, the fixing belt 22 coming into pressure contact with the pressuring roller 23 is co-rotated in an opposite direction to the pressuring roller 23 as indicated by an arrow D in FIG. 2. When the fixing belt 22 is thus rotated, the fixing belt 22 is slid onto the first heat transmitting part 61 and the second heat transmitting part 62 of the heat transmitting member 27.

In addition, in order to fix the toner image onto the sheet, the heater 26 is operated (turned on). When the heater 26 is operated, the radiant heat is radiated from the heater 26. The radiant heat radiated from the heater 26 to the first heat transmitting part 61 of the heat transmitting member 27 reaches directly the first heat transmitting part 61 as indicated by an arrow E in FIG. 2, and then, is absorbed by the first heat transmitting part 61. On the other hand, the radiant heat radiated from the heater 26 to the supporting member 25 is reflected by the reflecting part 67 of the reflecting member 28 and directed toward the first heat transmitting part 61 of the heat transmitting member 27 as indicated by an arrow F in FIG. 2 to reach the first heat transmitting part 61, and then, is absorbed by the first heat transmitting part 61. According to action as mentioned above, the heat transmitting member 27 is heated, and then, the fixing belt 22 is heated by heat transmission from the heat transmitting member 27. In such a situation, when the sheet passes through the fixing nip 43, the toner image is heated and molten, thereby fixing the toner image onto the sheet.

Incidentally, in the embodiment, in order to reduce heat capacity of the fixing belt 22, the fixing belt 22 is composed of the base material layer and the release layer without providing an elastic layer. If such composition is applied, when heat of the fixing belt 22 is taken by the sheet passing through the fixing nip 43, it is feared that fixability of the toner image onto particularly an end part at the downstream side of the sheet (a part, which is inserted latest into the fixing nip 43, of the sheet) is deteriorated.

However, in the embodiment, as described above, the second heat transmitting part 62 of the heat transmitting member 27 is sandwiched between a lower part (a corresponding part to the fixing nip 43) of the fixing belt 22 and the main body part 46 of the pressing member 24. By applying such a configuration, it is possible to make the second heat transmitting part 62 come into contact with the lower part of the fixing belt 22 at a corresponding area to the fixing nip 43 and to transmit heat from the second heat transmitting part 62 to the lower part of the fixing belt 22. Therefore, it is possible to continue to transmit the heat from the second heat transmitting part 62 to the fixing belt 22 while the sheet passes through the fixing nip 43, and then, to surely fix the toner image onto an entire area of the sheet containing the end part at the downstream side, even if the fixing belt 22 without an elastic layer is used. According to this, it is possible to shorten warm-up time and to enhance energy saving performance.

The heat transmitting member 27 is configured so that the length of the straight line L passing through the rotation axis A of the fixing belt 22 (the rotation center of the fixing belt 22) from the left end part P1 (the part at the downstream side in the sheet conveying direction) of the second heat transmitting part 62 to the point P2 on the first heat transmitting part 61 is longer than the internal diameter of the fixing belt 22 in the state that the heat transmitting member 27 does not come into contact with the inner circumference face (the state before the heat transmitting member 27 is attached). By applying such a configuration, it is possible to make the heat transmitting member 27 surely come into contact with the inner circumference face of the fixing belt 22 and to enhance heat transmitting performance from the heat transmitting member 27 to the fixing belt 22.

The distal end parts 73 of the plate springs 29 come into contact with the left side part (the part at the downstream side in the sheet conveying direction) of the inner circumference face of the fixing belt 22, and then, the fixing belt 22 is biased to the left side (to the downstream side in the sheet conveying direction) by the distal end parts 73 of the plate springs 29. By applying such a configuration, it is possible to make the heat transmitting member 27 further surely come into contact with the inner circumference face of the fixing belt 22 and to further enhance heat transmitting performance from the heat transmitting member 27 to the fixing belt 22.

Since the pressing member 24 is supported by the supporting member 25, it is possible to restrict the warp in the forward and backward directions of the pressing member 24. Since the radiant heat radiated from the heater 26 to the supporting member 25 is reflected by the reflecting part 67 of the reflecting member 28 and directed toward the first heat transmitting part 61 of the heat transmitting member 27, it is possible to prevent the radiant heat from being radiated to the supporting member 25 and to restrain heat from escaping to the supporting member 25.

Since the fixed part 68 of the reflecting member 28 comes into contact with the second bent part 65 of the heat transmitting member 27, it is possible to transmit heat of the reflecting member 28 to the fixing belt 22 via the heat transmitting member 27, when temperature of the reflecting member 28 is higher than the temperature of the heat transmitting member 27. Therefore, it is possible to restrain temperature rise of the reflecting member 28, and then, to restrain excessive temperature rise of a member supporting the reflecting member 28 and excessive temperature rise of the fixing belt 22 by heat transmission from the reflecting member 28 when rotation of the fixing belt 22 is stopped.

Each restriction piece 55 arranged at the left side (at the downstream side in the sheet conveying direction) of each protruding part 47 of the pressing member 24 is provided in the supporting member 25. Therefore, it is possible to surely restrict the pressing member 24 from moving to the left side (to the downstream side in the sheet conveying direction) when the fixing belt 22 is rotated.

A configuration heating the fixing belt 22 by the heat transmission from the heat transmitting member 27 heated by the heater 26 is applied. Therefore, as compared with a case of directly heating the fixing belt 22 by the heater 26, the excessive temperature rise of the fixing belt 22 is unlikely to be caused and, when a lubricant is applied between the fixing belt 22 and the heat transmitting member 27, a property (a heat resisting property) of the lubricant is unlikely to be deteriorated.

By making the heat transmitting member 27 come into contact with the inner circumference face of the fixing bet 22, it is possible to stabilize running track of the fixing belt 22 and to surely maintain a state that the first thermistor 40 comes into contact with the outer circumference face of the fixing bet 22. Moreover, it is possible to avoid inconvenience varying a distance between a non-contact type excessive temperature rise preventing device (a thermostat) and the fixing belt 22.

In the embodiment, a case where the fixing belt 22 is composed of the base material layer and the release layer was described. On the other hand, in another embodiment, the fixing belt 22 may include an elastic layer between the base material layer and the release layer. The elastic layer is made of, for example, silicone rubber having 5 degrees in JIS (Japanese Industrial Standard) hardness and a thickness of 200 μm.

In the embodiment, a case of making the base material layer of the fixing belt 22 by resin, such as PI (polyimide), was described. On the other hand, in another embodiment, the base material layer of the fixing belt 22 may be made of metal, such as nickel or SUS. In this case, in order to improve slidability of the fixing belt 22 onto the heat transmitting member 27, a sliding layer may be arranged at the inside of the base material layer in the radial direction of the fixing belt 22. The sliding layer is made of, for example, PI or fluorine-based resin.

Although the description in the embodiment was omitted, in another embodiment, a lubricant may be applied between the fixing belt 22 and the heat transmitting member 27. By applying such a configuration, it is possible to improve slidability of the fixing belt 22 onto the heat transmitting member 27. As the above-mentioned lubricant, for example, fluorine grease, silicone grease, silicone oil or the like may be used.

In the embodiment, a case where the reflecting member 28 partly comes into contact with the heat transmitting member 27 was described. On the other hand, in another embodiment, the reflecting member 28 may be arranged in a non-contact state to the heat transmitting member 27.

Although the description in the embodiment was omitted, in another embodiment, the heat transmitting member 27 may be made of carbon material. In such a case, application of the photothermal conversion paint onto the inner face of the heat transmitting member 27 may be omitted and application of nickel plating or fluorine coating onto the outer face of the heat transmitting member 27 may be omitted.

Although, in the embodiment, a case of making the reflecting member 28 by aluminum with high brilliance was described, in another embodiment, silver plating may be applied on a surface of the reflecting member 28.

Although, in the embodiment, a case of using the halogen heater as the heater 26 was described, in another embodiment, a ceramic heater or the like may be used as the heater 26.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt arranged rotatably;

a pressuring member arranged rotatably to come into pressure contact with the fixing belt so as to form a fixing nip;

a pressing member pressing the fixing belt to a side of the pressuring member;

a heat source arranged at the inside in a radial direction of the fixing belt to radiate a radiant heat; and a heat transmitting member coming into contact with an inner circumference face of the fixing belt to absorb the radiant heat radiated from the heat source, wherein a part of the heat transmitting member is sandwiched between the fixing belt and the pressing member, and wherein the heat transmitting member includes:

a first heat transmitting part coming into contact with a part at an upstream side in a sheet conveying direction of the inner circumference face of the fixing belt; and a second heat transmitting part extended from an end part at a side of the fixing nip of the first heat transmitting part to a downstream side in the sheet conveying direction and sandwiched between the fixing belt and the pressing member, the heat transmitting member is configured so that a length of a straight line passing through a rotation center of the fixing belt from an end part at the downstream side in the sheet conveying direction of the second heat transmitting part to the first heat transmitting part is longer than an internal diameter of the fixing belt in a state that the heat transmitting member does not come into contact with the inner circumference face of the fixing belt.

2. The fixing device according to claim 1 further comprising:

a biasing member coming into contact with a part at the downstream side in the sheet conveying direction of the inner circumference face of the fixing belt to bias the fixing belt to the downstream side in the sheet conveying direction.

3. The fixing device according to claim 1 further comprising:

a supporting member supporting the pressing member; and a reflecting member reflecting the radiant heat radiated from the heat source to the supporting member to direct reflected heat toward the heat transmitting member.

4. The fixing device according to claim 3, wherein, the reflecting member partly comes into contact with the heat transmitting member.

5. The fixing device according to claim 3, wherein, the pressing member includes:

a main body part pressing the fixing belt to the side of the pressuring member; and a protruding part provided in a face at a side separated from the fixing nip of the main body part, the supporting member includes:

a restriction piece arranged at the downstream side in the sheet conveying direction of the protruding part.

6. An image forming apparatus comprising:

the fixing device according to claim 1.

7. A fixing device comprising:

a fixing belt arranged rotatably;

a pressuring member arranged rotatably to come into pressure contact with the fixing belt so as to form a fixing nip;

a pressing member pressing the fixing belt to a side of the pressuring member;

a heat source arranged at the inside in a radial direction of the fixing belt to radiate a radiant heat; and a heat transmitting member coming into contact with an inner circumference face of the fixing belt to absorb the radiant heat radiated from the heat source;

wherein a part of the heat transmitting member is sandwiched between the fixing belt and the pressing member, the fixing device further comprising:

a supporting member supporting the pressing member; and a reflecting member reflecting the radiant heat radiated from the heat source to the supporting member to direct reflected heat toward the heat transmitting member, and wherein the reflecting member includes:

a reflecting part reflecting the radiant heat radiated from the heat source to the supporting member to direct the reflected heat toward the heat transmitting member; and a fixed part bent from an end part at the side separated from the fixing nip of the reflecting part to the downstream side in the sheet conveying direction and fixedly attached to the supporting member and the heat transmitting member.

8. The fixing device according to claim 7 further comprising:

a heat insulating spacer interposed between the fixed part and the supporting member.

9. The fixing device according to claim 8, wherein the fixed part is fixedly attached to the supporting member and the heat transmitting member by a fastening member, the heat insulating spacer is fitted around an outer circumference of the fastening member.

* * * * *